US006692346B2

(12) United States Patent
Bastian et al.

(10) Patent No.: US 6,692,346 B2
(45) Date of Patent: Feb. 17, 2004

(54) FUME HOOD WITH ALARM SYSTEM

(75) Inventors: John M. Bastian, Manitowoc, WI (US); Anthony Castelli, Manitowoc, WI (US)

(73) Assignee: Fisher Hamilton L.L.C., Two Rivers, WI (US)

( * ) Notice: Subject to any disclaimer, the term of this patent is extended or adjusted under 35 U.S.C. 154(b) by 0 days.

(21) Appl. No.: 10/126,285

(22) Filed: Apr. 19, 2002

(65) Prior Publication Data

US 2003/0027514 A1 Feb. 6, 2003

Related U.S. Application Data

(63) Continuation-in-part of application No. 09/922,037, filed on Aug. 3, 2001, now Pat. No. 6,506,109.

(51) Int. Cl.[7] ..... B08B 15/02
(52) U.S. Cl. ..... 454/56; 454/59
(58) Field of Search ..... 454/56, 49, 57, 454/58; 73/861.61, 861.64, 861.66

(56) References Cited

U.S. PATENT DOCUMENTS

| | | | | | |
|---|---|---|---|---|---|
| 4,040,042 | A | * | 8/1977 | Mayer | 454/340 |
| 4,466,341 | A | | 8/1984 | Grogan | |
| 4,528,898 | A | | 7/1985 | Sharp et al. | |
| 4,557,184 | A | * | 12/1985 | Orii et al. | 454/60 |
| 4,706,553 | A | | 11/1987 | Sharp et al. | |
| 4,934,256 | A | | 6/1990 | Moss et al. | |
| 4,982,605 | A | | 1/1991 | Oram et al. | |
| 5,092,227 | A | | 3/1992 | Ahmed et al. | |
| 5,170,673 | A | * | 12/1992 | Ahmed et al. | 73/865.9 |
| 5,215,497 | A | | 6/1993 | Drees | |
| 5,240,455 | A | | 8/1993 | Sharp | |
| 5,697,838 | A | | 12/1997 | Morris | |
| 5,882,254 | A | * | 3/1999 | Jacob | 454/61 |
| 5,920,488 | A | | 7/1999 | Arnold et al. | |
| 5,946,221 | A | | 8/1999 | Fish, Jr. et al. | |
| 5,988,860 | A | | 11/1999 | Hefferen et al. | |
| 6,024,638 | A | | 2/2000 | Berlin et al. | |
| 6,137,403 | A | | 10/2000 | Desrochers et al. | |
| 6,272,399 | B1 | | 8/2001 | Fish, Jr. et al. | |
| 6,350,194 | B1 | * | 2/2002 | Haugen et al. | 454/56 |
| 6,450,875 | B1 | * | 9/2002 | Haugen | 454/56 |

* cited by examiner

*Primary Examiner*—Derek Boles
(74) *Attorney, Agent, or Firm*—Rader, Fishman & Grauer PLLC

(57) ABSTRACT

A fume hood includes a top, bottom sidewalls, front panel and a back panel that define an enclosed workspace. The fume hood also includes a movable sash for opening and closing an access opening. The fume hood may also include an air chamber having an inlet in the front panel. The air chamber includes a baffle system that evenly distributes the inlet air as the air travels through the air chamber. An unimpeded flow of air is discharged downward and away from the breathing zone of the technician and proximate to the sash to reduce the forward momentum of air trying to escape the fume hood. In an alternate embodiment, the fume hood also includes an alarm system to provide a visual and/or audible indication to the user of a working condition of the fume hood. The characteristics of the visual indication and the audible indication may vary depending on the position of the movable sash and the measured airflow from the discharge of the air chamber.

19 Claims, 4 Drawing Sheets

Fig. 2
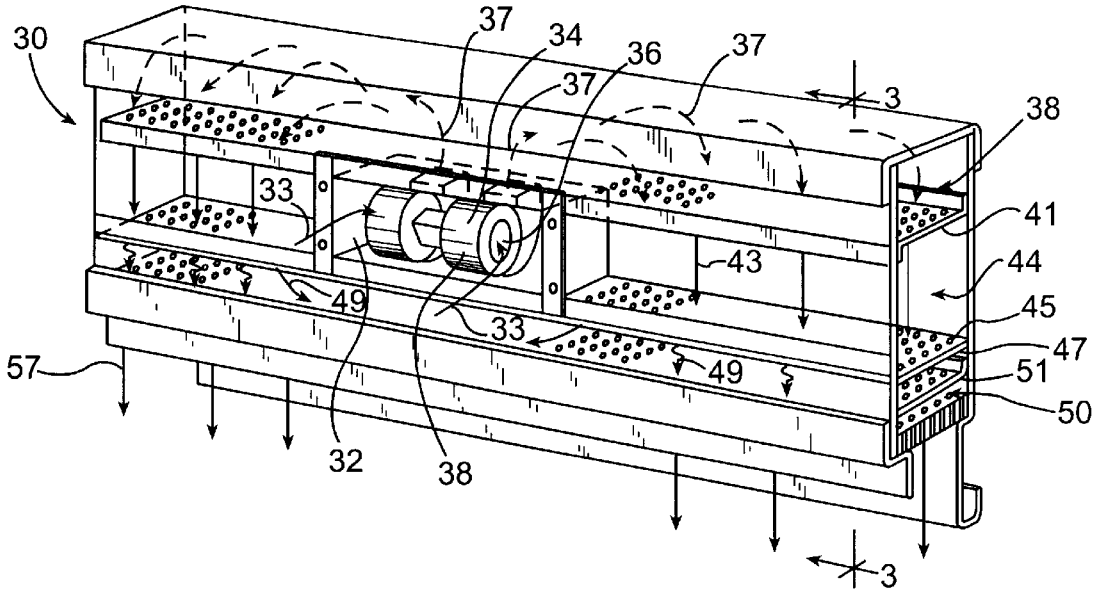
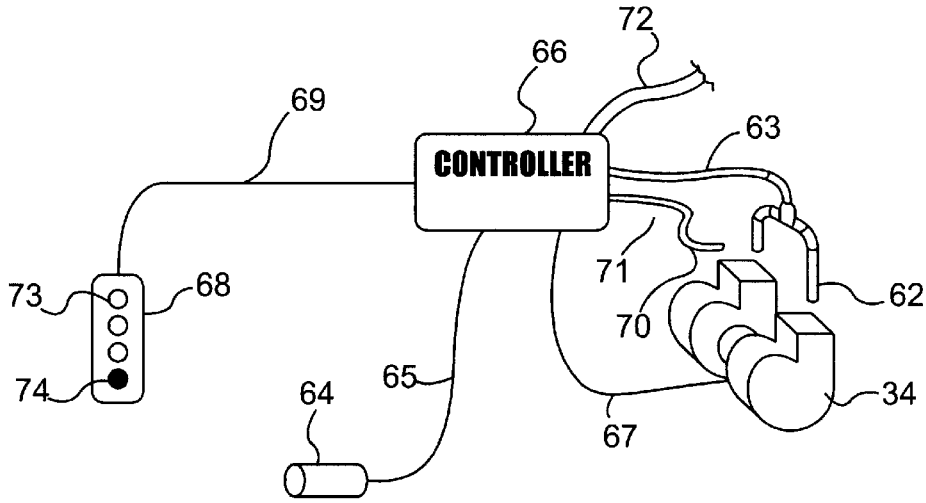
Fig. 6

Fig. 3
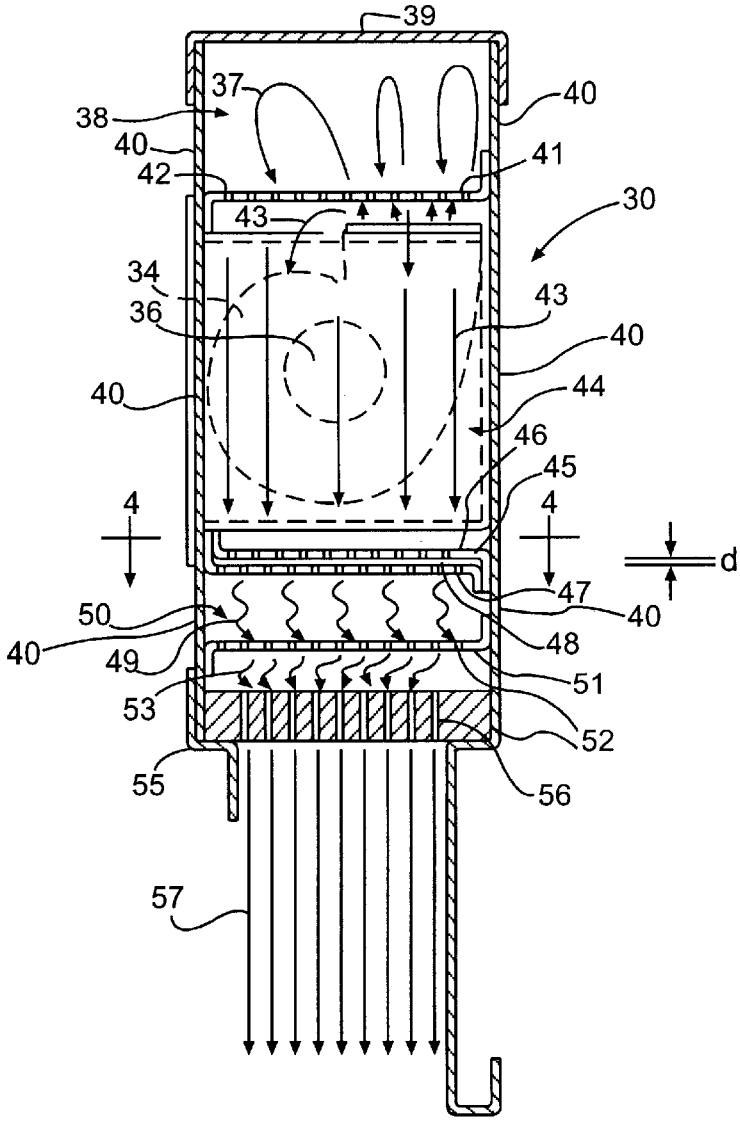
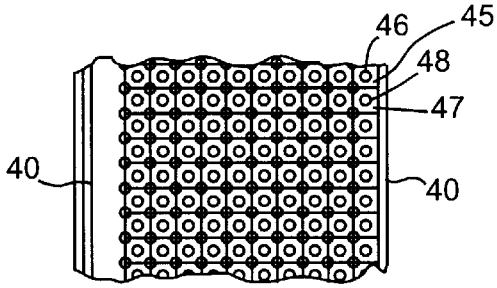
Fig. 4

FUME HOOD WITH ALARM SYSTEM

CROSS NOTING TO RELATED APPLICATIONS

This application is a Continuation-In-Part of application Ser. No. 09/922,037 filed Aug. 3, 2001, now U.S. Pat. No. 6,506,109.

BACKGROUND OF THE INVENTION

1. Field of the Invention

The present invention relates to a fume hood apparatus, and in particular to a fume hood apparatus with an alarm system that monitor the fume hood's key system components and provides an audible and/or visual indication of a set-up, normal or abnormal condition.

2. Description of the Related Art

Fume hoods are protective enclosures that provide ventilated and illuminated workspaces for laboratory or other applications. A fume hood in its most basic form is a box with an inlet and an outlet. The inlet generally has a movable sash (vertically, horizontally or a combination of both), which provides an opening that allows access to the workspace. The procedures performed inside the fume hood are exhausted at the back through the top of the fume hood to a heating, venting and air conditioning (HVAC) system.

For safety considerations, it is desirable that the technician be provided with information relating to one or more working conditions of the fume hood. The inventors of the present invention have recognized this problem and have developed a fume hood with an alarm system that provides a visual and/or audible indication of one or more fume hood working conditions.

SUMMARY OF THE INVENTION

The present invention comprises a fume hood apparatus including an enclosure, a movable sash and an optional air chamber. The optional air chamber includes an inlet for drawing air into the air chamber. Initially, the airflow travels upward into the air chamber. A backpressure redirects the airflow to travel downward through one or more baffles that evenly distribute the airflow within the air chamber as the airflow travels through the air chamber. A discharge positioned proximate to the face of the fume hood directs an unimpeded flow of air through the face of the fume hood. When the air moves into the fume hood around the technician's body, an air turbulence may be created between the technician's body and face of the fume hood in the breathing zone. By directing an unimpeded flow of air downward across the breathing zone of the technician, the air from the air chamber reduces the forward momentum of air trying to escape the fume hood, thereby reducing airborne contaminants from escaping through the face of the fume hood. Further, airborne contaminants are reduced from escaping from the workspace even when the movable sash is fully opened resulting in improved containment performance.

In one embodiment of the invention, the fume hood also includes an alarm system for providing a visual and/or audible indication of one or more working conditions of the fume hood. In this embodiment, the alarm system includes an air flow sensor preferably located in the air chamber for measuring air flow characteristics, such as velocity, air flow rate, or the like, and a sash position sensor for determining the position of the movable sash with respect to a predetermined height above the bottom of the sash opening. The alarm system also includes a controller for processing the signals from the air flow sensor and the sash position sensor and for providing a signal to one of the visual and audible indicators depending on the characteristics of air flow and the position of the movable sash.

Various aspects and advantages of this invention will become apparent to those skilled in the art from the following detailed description of the preferred embodiment, when read in light of the accompanying drawings.

BRIEF DESCRIPTION OF THE DRAWINGS

FIG. 2 is a perspective view of the air chamber of the present invention;

FIG. 3 is a cross-sectional view of the air chamber taken along line 3—3 of FIG. 2;

FIG. 4 is a cross-sectional view of an airfoil taken along line 4—4 of FIG. 3;

FIG. 6 is a plan view of the alarm system according to the alternative embodiment of the present invention.

DESCRIPTION OF THE PREFERRED EMBODIMENT

Figure 1:
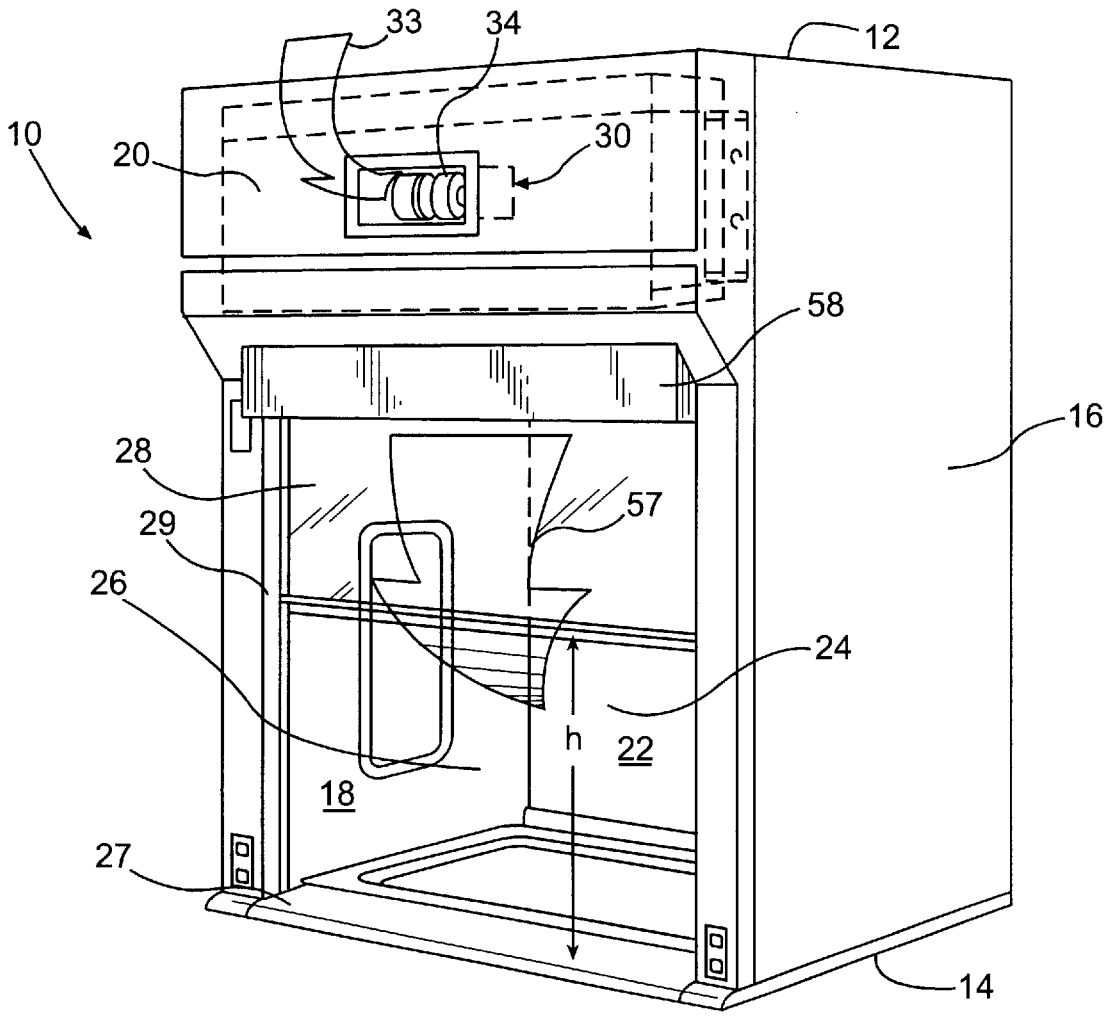
FIG. 1 is a perspective view of the fume hood apparatus of the present invention.

Referring now to FIGS. 1–4, a fume hood apparatus is shown generally at 10 according to the present invention. The fume hood apparatus 10 generally includes an enclosure comprising a cover or top 12, a bottom 14 opposite the top 12, sidewalls including a first end panel 16, a second end panel 18 opposite the first end panel 16, a front panel 20, and a back panel 22 opposite the front panel 20. The enclosure may be made of metal or any other material of high strength and rigidity.

The enclosure defines a workspace 24 and an access opening 26 through which a technician may reach into the workspace 24. A moveable sash 28 is slidably mounted to the enclosure in a frame member 29 to allow the selective closing of the opening 26 and precluding access to the workspace 24. The sash 28 is preferably made of glass or any other similar material. The technician may raise the sash 28 to allow access through the opening 26, as shown in FIG. 1, or lower the sash 28 to close the opening 26.

The fume hood apparatus 10 may include a baffle system (not shown) that cooperates with a fan (not shown) to evacuate any fumes generated in the workspace 24. Typically, the baffle system lies at the back of the workspace 24 and directs the fumes to a discharge conduit (not shown). As the fan draws the air and fumes out of the workspace 24, ambient air flows into the workspace 24, primarily through the opening 26. The fume hood apparatus may also include a base member (not shown) to define a work surface and for positioning the fume hood apparatus 10 at a desired elevation for the technician, and an airfoil 27. It will be understood that the type of baffle system does not limit the invention, base member or airfoil, and that the invention can be practiced with any type of baffle system, base member, and airfoil well known in the art. Examples of a baffle system, a base member and an airfoil are described in U.S. Pat. No. 5,556,331 to Bastian, the entire contents of which are herein incorporated by reference.

As best seen in FIG. 2, one aspect of the invention is that the fume hood apparatus may include an air chamber, shown generally at 30, preferably located in the front panel 20 of the enclosure. In general, the air chamber 30 includes an upper portion 38, a middle portion 44 and a bottom portion 50.

The middle portion 44 of the air chamber 30 includes an inlet 32 for outside or drawing room air into the air chamber 30 in the direction of arrows 33. Preferably, the air is drawn into the inlet 32 of the air chamber 30 by a centrifugal fan 34 driven by a rotating means, such as a motor 35. As best shown in FIG. 3, the air is drawn into the intake 36 of the centrifugal fan 34 and exits the centrifugal fan 34 in an upward direction, as indicated by the arrows 37, into the upper portion 38 of the air chamber 30. In one embodiment of the invention, the centrifugal fan 34 provides an airflow in the range of between about 40 to about 250 cubic feet/minute through the air chamber 30.

The upper portion 38 is defined by an upper wall 39, sidewalls 40, and a baffle 41. The baffle 41 includes a plurality of perforations or openings 42 for allowing a portion of the intake air to travel upward and pass through the openings 42, as designated by the arrows 37. It should be noted that the outlet of the centrifugal fan 34 is not positioned into abutting engagement with the baffle 41, but is positioned at a predetermined distance from the baffle 41. As a result, a portion of the intake air does not pass through the openings 42, but impinges upon the baffle 41 and travels downward, as indicated by the arrows 43. As a result, a backpressure is created within the upper portion 38 to redirect the airflow downwardly through the openings 42 of the baffle 41 and into the middle portion 44 of the air chamber 30.

The middle portion 44 of the air chamber 30 is defined by the baffle 41, the sidewalls 40 and a baffle 45. Similar to the baffle 41, the baffle 45 includes perforations or openings 46. The airflow travels downward, as indicated by the arrows 43, through the middle portion 44 of the air chamber 30. The middle portion 44 of the air chamber 30 may also include a baffle 47 with perforations or openings 48 that is positioned proximate to the baffle 45 to distribute the airflow more evenly as the air flows downward, as indicated by the arrows 49, into a bottom portion 50 of the air chamber 30. As best seen in FIG. 3, the baffles 45 and 47 are separated by a distance, "d", in the range between about 0.10 and about 0.25 inches. At this separation distance, it has been found that the redirecting and distribution of the airflow into the bottom portion 50 is optimized. However, it will be appreciated that the separation distance, "d", between baffles 45 and 47 can be any desired distance to optimize the redirecting and distribution of airflow into the bottom portion 50 of the air chamber 30. Preferably, the bottom portion 50 extends the entire length of the air chamber 30, unlike the middle portion 44 that houses the intake 32, centrifugal fan 34 and motor 35. As best seen in FIG. 4, the openings 48 of the baffle 47 are vertically and horizontally offset from the openings 46 of the baffle 45. This configuration ensures that the airflow is evenly distributed as the airflow travels within the bottom portion 50 of the air chamber 30. It will be appreciated that the invention is not limited by the degree in which the openings 46 and 48 are offset from each other, and that the invention can be practiced with any desired degree of offset.

Referring now to FIG. 3, the bottom portion 50 of the air chamber 30 is defined by the baffle 47, the sidewalls 40 and an air straightener 55. The bottom portion 50 also includes a baffle 51 with perforation or openings 52 to allow the airflow to travel through the bottom portion 50, as indicated by the arrows 53. After passing through the baffle 51, the airflow passes through an air straightener 55 having one or more ducts 56 for directing the airflow outwardly in a substantially uniformly linear direction from the air chamber 30, as indicated by the arrows 57. Referring now to FIG. 1, the fume hood apparatus 10 may include a discharge 58 to assist in directing the airflow from the air chamber 30.

It will be appreciated that the baffles 41, 45, 47 and 51 form a baffle system within the air chamber 30. One purpose of the baffle system is to redirect and evenly distribute the airflow as it travels downward through the air chamber 30. Although the baffle system of the invention includes baffles 41, 45, 47 and 51, it will be appreciated that the number of baffles within the air chamber 30 to redirect and evenly distribute the airflow does not limit the invention. Thus, the invention can be practiced with any desired number of baffles that would evenly distribute the airflow as it travels downward through the air chamber 30.

One aspect of the invention is the location at which the airflow exits the air chamber 30. Unlike conventional fume hood designs, the fume hood apparatus 10 of the invention directs the airflow at a location above the technician and between the technician and the movable sash 28. Specifically, the discharge 58 is located immediately adjacent and proximate to the movable sash 28 in such a manner that a technician does not impede the airflow from the discharge 58, unlike conventional fume hood designs. At this location, it has been found that the face velocity of the fume hood apparatus 10 is reduced while maintaining requirements for adequate containment of the fumes. It has also been found that the centrifugal fan 34 is required to operate when the access opening 26 has a minimum amount of surface area for a particular amount of airflow.

As best seen in FIG. 1, the centrifugal fan 34 may only need to be operated when the movable sash 28 is positioned, for example, at or above a minimum height, "h", in a range of about 10 to 24 inches above the bottom 14 of the fume hood apparatus 10. The centrifugal fan 34 can be switched on and off by any well-known type of switching means, such as a limit switch (not shown). Operating the centrifugal fan 34 only when the movable sash 28 is positioned at or above the minimum height, "h", provides for a more energy efficient design as compared to a fume hood design in which the fan is continuously operated. Of course, the invention can be practiced with a continuously operated centrifugal fan 34. In addition, the invention can be practiced with other types of fans. It should be noted that the air could be introduced into the air chamber 30 at other locations than the front panel 20. For example, the air may be introduced into the top 12 or the sides 16 of the fume hood apparatus 10.

In addition, by providing an airflow at this location allows the fume hood apparatus 10 to maintain containment requirements even though the movable sash 28 is positioned above the minimum distance from the bottom 14 and the airfoil 27 is approximately flush with the bottom 14. This aspect of the invention provides a significant advantage over conventional fume hood designs in which the access opening must be reduced by requiring a raised airfoil and/or lower the movable sash 28 in order to achieve the required containment level at low face velocities.

Figure 5:
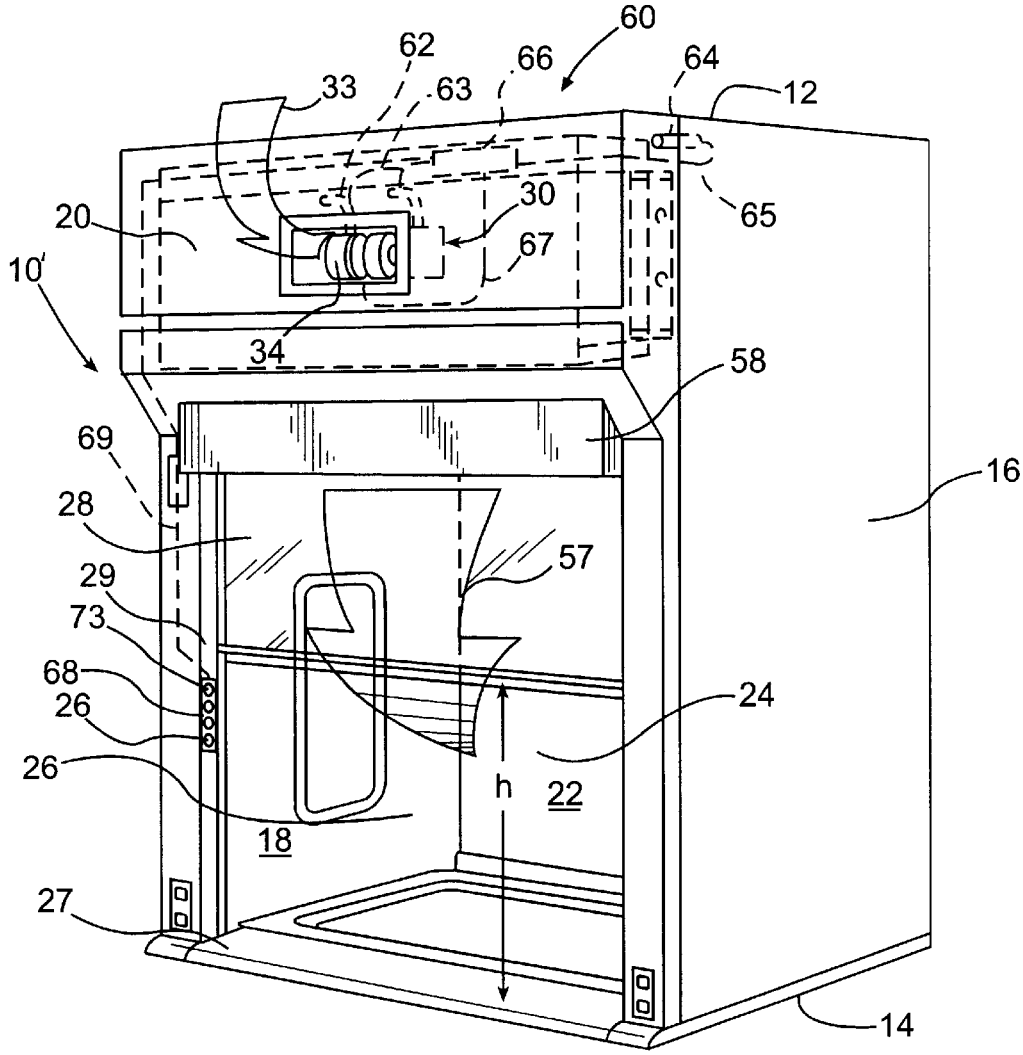
FIG. 5 is a perspective view of the fume hood apparatus with the air chamber and an alarm system according to an alternative embodiment of the present invention.

Referring now to FIGS. 5 and 6, a fume hood apparatus is shown generally at 10' according to an alternative embodiment of the present invention. For brevity, the similar components of the fume hood apparatus 10' are given the same reference numerals as in the fume hood apparatus 10 and will not be discussed below.

The fume hood apparatus 10' is substantially similar to the fume hood apparatus 10, except that the fume hood apparatus 10' includes an alarm system, shown generally at 60, for providing an indication to the technician of a working condition of the fume hood apparatus 10. In the case where the fume hood apparatus 10' is equipped with an air chamber 30 with a centrifugal fan 34, the alarm system 60 includes a device for measuring air characteristics such, as the velocity, air flow rate, or the like, of air discharged from the centrifugal fan 34. In the illustrated embodiment, an airflow sensor 62 can be used to measure the airflow velocity (or airflow rate) from the discharge of the centrifugal fan 34. The alarm system 60 also includes a device for measuring the position of the movable sash 28, such as a position sensor 64. Further, the alarm system 60 includes a control unit or controller 66 that is operatively connected to the airflow sensor 62 (if equipped) and the sash position sensor 64 via connections 63, 65, respectively.

The airflow sensor 62 may comprise one or more pitot tubes of a type well known in the art that measures the velocity of the discharge air from the centrifugal fan 34. The measured velocity of the air can be compared to a reference air pressure that can be measured by a static pressure tube 70, or the like, operatively connected to the controller 66 via connection 71. It will be appreciated that the invention is not limited by the means for measuring the velocity of the discharge air and that the invention can be practiced by other well-known means for measuring air velocity. Moreover, in combination with measuring airflow velocity or airflow rate, the use of other information known in the art may provide additional information including the quantity of airflow through the fume hood apparatus 10.

The controller 66 is electrically connected to the motor 35 of the centrifugal fan 34 via a connection 67. In addition, the controller is electrically connected to an indicating device 68 via a connection 69 and is also electrically connected to a power supply (not shown) via a connection 72. The indicating device 68 may include one or more visual indicators 73, such as light bulbs that can emit different light frequencies in the visible spectrum, such as red, green and yellow. Further, the visual indicators 73 can blink at variable time intervals. In addition, the indicating device 68 may include an audible indicator 74, such as a buzzer, or the like. Preferably, the indicating device 68 is mounted in a prominent location on the front of the fume hood apparatus 10 so as to be easily seen and/or heard by the technician.

In operation, the alarm system 60 provides a visual and/or audible indication of the working condition of the key components of the fume hood apparatus 10. To accomplish such an indication, the controller 66 can be programmed any number of ways depending on the type of fume hood design. For example, for unframed sash fume hood designs, the controller 66 may be programmed as follows:

When the movable sash 28 is located between the bottom or work surface 14 and the predetermined height, h, the visual indicator 73 emits light at a first frequency, such a green, and there is no audible sound emitted from the audible indicator 74.

When the movable sash 28 is located above the predetermined height, h, and the airflow from the discharge of the centrifugal fan 34 (if equipped) is at or above a predetermined airflow (for example, represented by either flow velocity or the quantity of air movement over a period of time), the visual indicator 73 emits light at the first frequency, or at a second frequency, such as yellow, or both, and the audible indicator 74 emits sounds at a first time interval, and/or at a first pitch or frequency, and/or at a first amplitude or volume, indicating that the fume hood apparatus 10 is in a set-up mode.

When the movable sash 28 is located above the predetermined height, h, and the airflow from the discharge of the centrifugal fan 34 (if equipped) is below the predetermined airflow, the visual indicator 73 emits light at a third frequency, such as red, and the audible indicator 74 emits sounds at a second time interval that is more frequent than the first time interval, and/or at a second pitch or frequency that is different than the first pitch or frequency, and/or at a second amplitude or volume that is different than the first amplitude or volume.

For framed combination sash fume hood designs, the controller 66 may be programmed as follows:

When the movable sash 28 is at the bottom or work surface 14, the visual indicator 73 emits light at a first frequency, such a green, and there is no audible sound emitted from the audible indicator 74.

When the movable sash 28 is located between the bottom or work surface 14 and the predetermined height, h, the visual indicator 73 emits light at the first frequency, or at a second frequency, such as yellow, or both, and the audible indicator 74 emits sounds at a first time interval indicating that the fume hood apparatus 10 is in a set-up mode.

When the movable sash 28 is located above the predetermined height, h, and the airflow from the discharge of the centrifugal fan 34 (if equipped) is at or above a predetermined airflow, the visual indicator 73 emits light at the first frequency, or at the second frequency, or both, and the audible indicator 74 emits sounds at the first time interval, and/or at a first pitch or frequency, and/or at a first amplitude or volume, indicating that the fume hood apparatus is in a set-up mode.

When the movable sash 28 is located above the predetermined height, h, and the airflow from the discharge of the centrifugal fan 34 (if equipped) is below the predetermined airflow, the visual indicator 73 emits light at a third frequency, such as red, and the audible indicator 74 emits sounds at a second time interval that is preferably more frequent than the first time interval, and/or at a second pitch or frequency that is different than the first pitch or frequency, and/or at a second amplitude or volume that is different than the first amplitude or volume.

As described above, the fume hood apparatus 10' of the invention monitors the key components of the fume hood apparatus 10' and provides a visual and/or audible indication of the working conditions of these key components to the technician. By providing a visual and/or audible indication of the working conditions, the fume hood apparatus 10' of the invention helps to reinforce good work practices of the technician.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fume hood apparatus, comprising:

an enclosure defining a workspace and an access opening, the enclosure including a bottom defining a work surface;

a movable sash for closing the access opening;

an alarm system including an airflow sensor for measuring an airflow from a discharge of an air chamber and a position sensor for sensing a position of the movable sash with respect to the work surface; and wherein the alarm system provides an indication to a user of a working condition of the fume hood apparatus by a visual indication when the movable sash is positioned between the work surface and a predetermined height above the work surface.

2. The fume hood apparatus of claim 1, wherein the visual indication comprises light emitted at a first frequency.

3. A fume hood apparatus, comprising:

an enclosure defining a workspace and an access opening, the enclosure including a bottom defining a work surface;

a movable sash for closing the access opening;

an alarm system including an airflow sensor for measuring an airflow from a discharge of an air chamber and a position sensor for sensing a position of the movable sash with respect to the work surface; and wherein the alarm system provides an indication to a user of a working condition of the fume hood apparatus by a visual and audible indication when the airflow from the discharge of the air chamber is at or above a predetermined airflow and the movable sash is positioned above the predetermined height above the work surface.

4. The fume hood apparatus of claim 3, wherein the visual indication comprises light emitted at a second frequency, and wherein the audible indication comprises sound emitted at a first time interval.

5. A fume hood apparatus, comprising:

an enclosure defining a workspace and an access opening, the enclosure including a bottom defining a work surface;

a movable sash for closing the access opening;

an alarm system including an airflow sensor for measuring an airflow from a discharge of an air chamber and a position sensor for sensing a position of the movable sash with respect to the work surface; and wherein the alarm system provides an indication to a user of a working condition of the fume hood apparatus by a visual and audible indication when the airflow from the discharge of the air chamber is below the predetermined airflow and the movable sash is positioned above the predetermined height above the work surface.

6. The fume hood apparatus of claim 5, wherein the visual indication comprises light emitted at a third frequency, and wherein the audible indication comprises sound emitted at one of a second time interval, a second frequency and a second amplitude.

7. A fume hood apparatus, comprising:

an enclosure defining a workspace and an access opening, the enclosure including a bottom defining a work surface;

a movable sash for closing the access opening;

an alarm system including a position sensor for sensing a position of the movable sash with respect to the work surface; and wherein the alarm system provides an indication to a user of a working condition of the fume hood apparatus by a visual indication when the movable sash is positioned on the work surface.

8. The fume hood apparatus of claim 7, wherein the visual indication comprises light emitted at a first frequency.

9. A fume hood apparatus, comprising:

an enclosure defining a workspace and an access opening, the enclosure including a bottom defining a work surface;

a movable sash for closing the access opening; and an alarm system for providing one of an audible indication and a visual indication to a user of a working condition within the workspace of the fume hood apparatus, wherein one of the audible indication and the visual indication is a function of a position of the movable sash with respect to the work surface of the fume hood apparatus.

10. The fume hood apparatus of claim 9, wherein the alarm system provides only the visual indication when the movable sash is positioned between the work surface and a predetermined height above the work surface.

11. The fume hood apparatus of claim 10, wherein the visual indication comprises light emitted at a first frequency.

12. The fume hood apparatus of claim 9, wherein the alarm system provides both a visual and audible indication when an airflow from a discharge of an air chamber is at or above a predetermined airflow and the movable sash is positioned above the predetermined height above the work surface.

13. The fume hood apparatus of claim 12, wherein the visual indication comprises light emitted at a second frequency, and wherein the audible indication comprises sound emitted at a first time interval.

14. The fume hood apparatus of claim 9, wherein the alarm system provides both a visual and audible indication when the airflow from the discharge of the air chamber is below the predetermined airflow and the movable sash is positioned above the predetermined height above the work surface.

15. The fume hood apparatus of claim 14, wherein the visual indication comprises light emitted at a third frequency, and wherein the audible indication comprises sound emitted at one of a second time interval, a second frequency and a second amplitude.

16. The fume hood apparatus of claim 9, wherein the alarm system provides only a visual indication when the movable sash is positioned on the work surface.

17. The fume hood apparatus of claim 16, wherein the visual indication comprises light emitted at a first frequency.

18. A method of providing an indication of a working condition of a fume hood, comprising the steps of:

supplying an airflow to an air chamber of the fume hood;

measuring an airflow from a discharge of the air chamber;

sensing a position of a movable sash with respect to a work surface of the fume hood; and providing one of a visual indication and an audible indication to a technician as a function of the position of the movable sash with respect to the work surface of the fume hood.

19. The method of claim 18, further comprising the steps of:

measuring an airflow from a discharge of an air chamber; and providing one of a visual indication and an audible indication to a technician as a function of the airflow from the discharge of the air chamber and the position of the movable sash with respect to the work surface of the fume hood.

* * * * *